United States Patent [19]

Domenig

[11] Patent Number: 4,934,639

[45] Date of Patent: Jun. 19, 1990

[54] FOLDABLE LEVELLER LEG ASSEMBLY

[76] Inventor: Georg Domenig, 2026 Twin Pines, Kernersville, N.C. 27284

[21] Appl. No.: 252,154

[22] Filed: Oct. 3, 1988

[51] Int. Cl.[5] ..... A47B 91/00

[52] U.S. Cl. ..... 248/188.4; 248/188.6

[58] Field of Search ..... 248/188.4, 188.5, 188.6, 248/439, 650; 312/255, 256; 108/129, 175

[56] References Cited

U.S. PATENT DOCUMENTS 2,799,548 7/1957 Arden ..... 108/125 X 4,222,559 9/1980 Hammer ..... 248/188.5 X

FOREIGN PATENT DOCUMENTS 2067393 7/1981 United Kingdom ..... 248/240.2

*Primary Examiner*—Alvin C. Chin-Shue

[57] ABSTRACT

A foldable leveller leg assembly for supporting an article having a base member directly engaging the article, a leg member pivotally connected to the base member and a foot member adjustably affixed to the leg member. Several means are available for securing the base member to the article. Alternate means may be utilized to lock the leg member in a substantially fixed relationship with respect to the base member so that the leg member can sustain the article when in a vertical position and be folded against it when the article is to be shipped, stored or relocated. The foot member can move independent of a connected stationary element engaging the supporting surface. A roller device associated with the base member enables the article to be moved over a supporting surface when the leg member is in the folded and substantially horizontal position.

6 Claims, 5 Drawing Sheets

150
140
130

82
84
86
88
90
92
94
96
98
102
103
104
106
108
110

FOLDABLE LEVELLER LEG ASSEMBLY

NATURE OF THE INVENTION

This invention relates generally to the field of adjustable legs for cabinets, tables and furniture of all descriptions. It is particularly suitable for use with kitchen cabinets and related equipment in homes, restaurants, schools and hospitals.

The invention relates particularly to a foldable leg assembly with means for adjusting the length of the supporting leg so that a plurality of such assemblies can support a variety of articles and adjust or compensate for irregularities in the floor or other supporting surface on which the article rests.

BACKGROUND OF THE INVENTION

Levelling devices for furniture and other articles are not new, and have been used for quite some time in Europe, but such devices are expensive, usually complex in construction, and predominantly affixed to the structure to be supported in a rigid manner with only that portion of the device engaging the supporting surface susceptible to movement in order to achieve levelling. Thus, articles equipped with such levelling devices occupy more space when being transported as a result of this construction. If the levelling devices are removed for shipment, the securing mechanism becomes worn and frequently develops a loose fit when it is actuated several times during removal and reinstallation. Moreover, the removed adjustable legs must be packed separately and shipped either with the article to be supported or independent thereof thereby subjecting them to loss or misplacement.

SUMMARY OF THE INVENTION

The present invention is an improved adjustable leg assembly which is capable of being folded in a nested or substantially parallel position with respect to the bottom or underside of the article to be supported thus conserving space and avoiding the inconvenience and wear associated with removing and reattaching conventional adjustable legs for shipment or repositioning.

The foldable leveller leg assembly constituting the present invention includes in one embodiment a molded base member having a flange plate that engages the underside of the supported article. A threadable member extends from the supported article into a receiving channel within the base member. A leg member extends into a recessed lower portion of the base member and is pivotally held by one or more removable pins. The leg member can be pivoted to an upright article supporting position and back to a folded and nested position for shipment or storage. Means are provided to releasably secure the leg member in the folded and nested position.

A foot member is threadably secured to the leg member so that it can be rotated to fix its location in a predetermined relationship with the leg member to locate the height of the supported article thereby compensating for an uneven supporting surface. A sleeve can be positioned over the foot member which will remain stationary against the supporting surface as the foot member is rotated to vary the length of the leg member and the height of the supported article.

The leg member may have one or more longitudinally extending slots cooperatively engaging the pins affixing it to the base member so that it can be locked in a vertical position with respect to the base member to support the article. It may alternatively utilize a series of longitudinal ribs that cooperatively engage formed grooves or channels in the base member to lock the leg member in a vertical article-supporting position.

The base member of the assembly constituting the present invention may also be secured directly to the bottom of the supported article so as to avoid an aperture in that surface resulting when a threaded member such as described above is used. In such a construction, screws may be used to secure the flange to the bottom of the supported article thus providing a smooth interior floor in the supported article uninterrupted by perforations or plugs covering holes to accommodate the threaded members.

The assembly can also be affixed to the bottom of the supported article by one or more dowels force-fitted manually or by a machine designed specifically for that purpose.

If desired, the assembly can also be affixed to the toe kick panel of a cabinet rather than the cabinet's bottom, since automated equipment is currently available to affix such elements to walls or surfaces of cabinets and similar articles.

Obviously, the parts of the present invention can be made of metal, plastic, or other suitable material.

The foot member can be adjusted with respect to the leg member by extending a screwdriver through the aperture within the threaded member and through the bottom of the supported article or by utilizing a wrench or screwdriver at the foot member. In the event no opening is desired in the bottom of the supported article, height adjustment can still be accomplished at the toe member.

From the summary above, it can be seen that a primary object of the present invention is to provide a foldable leveller leg assembly which can permit the retraction of the leg to a nested position against the supported article when the article is moved or transported.

Another object of the present invention is to provide a foldable leg assembly that can provide for more than one means of adjusting the height of the supported article.

Another object of the present invention is to provide a foldable leveller leg assembly of suitable design to render the assembly universally adaptable for attachment to cabinets, food service equipment, tables and furniture.

Yet another object of the present invention is to provide a foldable leveller leg assembly for supporting an article that is simple in design, inexpensive to manufacture, and trouble-free in use.

Yet still another further object of the present invention is to provide a foldable leveller leg assembly for supporting an article that has roller means associated with its base member enabling the article to be moved over a supporting surface when the leg member is in the folded and nested position.

Other objects and a fuller understanding of the present invention will be had by referring to the following detailed description and claims of embodiments of the invention.

BRIEF DESCRIPTION OF THE DRAWINGS

In the drawings where characters of reference refer to described structure and operation

DETAILED DESCRIPTION OF THE INVENTION

Figure 1:
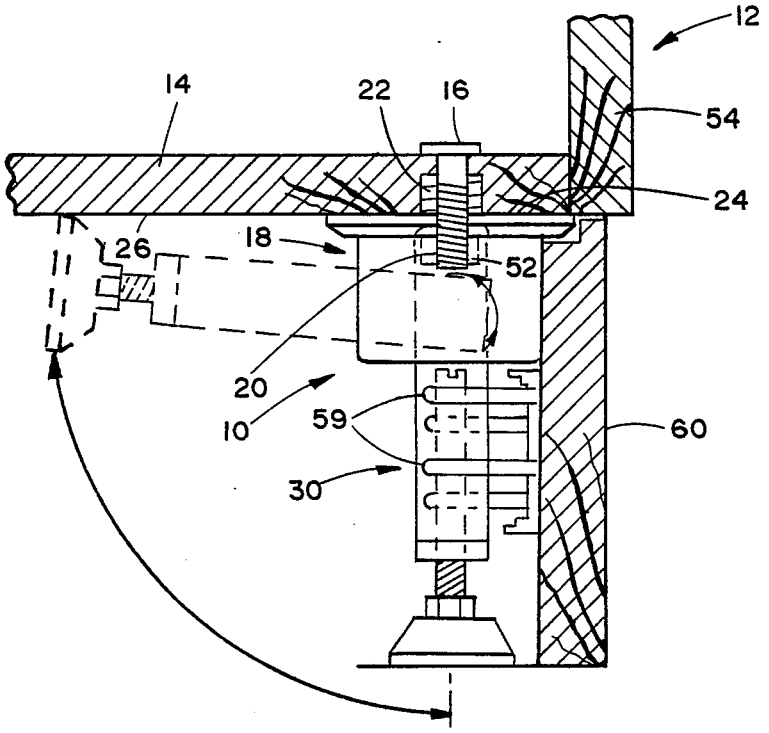
FIG. 1 is a front elevational sectional view of one embodiment of the present invention affixed to a cabinet showing in solid lines the leg and foot members positioned in a vertical supporting configuration and in hidden lines the leg and foot members in a retracted nested condition.
Figure 2:
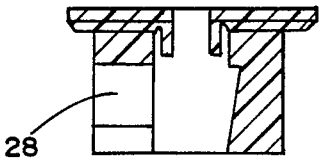
FIG. 2 is a front elevational sectional view of the base member of the present invention shown in FIG. 1.
Figure 3:
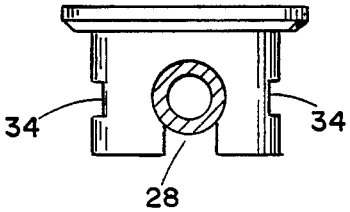
FIG. 3 is a side elevational view of the base member shown in FIG. 1 and FIG. 2.
Figure 11:
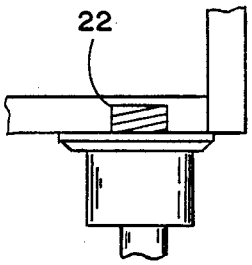
FIG. 11 is a side elevational sectional view of another embodiment of the base member of the present invention which does not require an aperture in the floor of the supported article.
Figure 12:
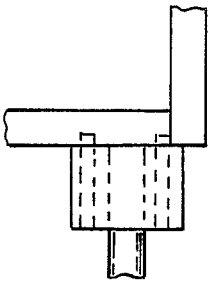
FIG. 12 is a side elevational sectional view of another embodiment of the base member of the present invention which is attached with dowels.

Referring now to the drawings and particularly to FIG. 1, one embodiment of the foldable leveller leg assembly of the present invention shown generally as 10 is supporting a corner of a cabinet shown generally as 12 similar to those used in home and commercial kitchens. The floor or bottom 14 of cabinet 12 is perforated to receive a threaded member 16 that extends therethrough and into a base member shown generally as 18. Base member 18 has a threaded opening 20 which cooperatively receives threaded member 16. In some instances, it is desirable to include a threadable sleeve 22 within the floor 14 of the cabinet 12 to strengthen the opening through which threaded member 16 extends. It is also possible to use a sleeve 22' alone positioned in the cabinet floor 14 as shown in FIG. 11 which can be attached manually or automatically.

Figure 10:
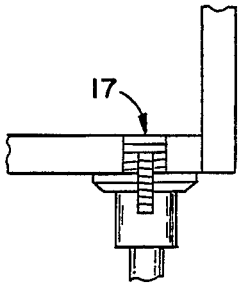
FIG. 10 is a side elevational sectional view of an alternate embodiment of the base member of the present invention showing a counter-sunk threaded member covered by a plug.

Base member 18 has a flange plate 24 that engages the lower surface 26 of floor 14. Should it be desirable to eliminate threaded member 16 and the aperture in the floor 14 of cabinet 12, screws (not shown) can be used to secure flange plate 24 to the lower surface 26 of floor 14. If threaded member 16 is deemed necessary but a raised surface on the cabinet floor is undesirable, member 16 can be recessed and hidden by a flush plug 17 as shown in FIG. 10.

Figure 4:
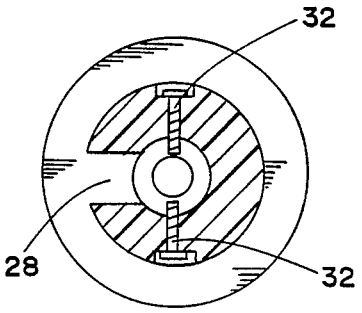
FIG. 4 is a plan view of the base member showing receiving pins for communicating with an attached leg member.

Base member 18 has a U-shaped recess 28 which permits the pivotal movement of the leg member shown generally as 30 which movement will be described in greater detail subsequently. Pins 32 are cooperatively received by apertures 34 within the base member as shown in FIG. 4.

Figure 5:
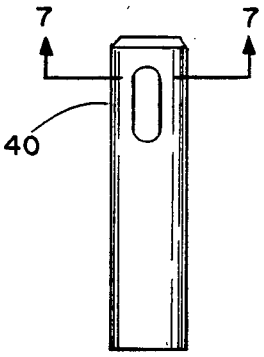
FIG. 5 is a side elevational view of the leg member showing a single longitudinal slot.
Figure 6:
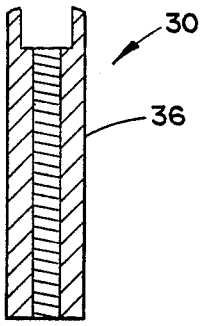
FIG. 6 is an elevational sectional view of the leg member.
Figure 7:
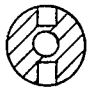
FIG. 7 is a plan view of the leg member taken along the line 7—7.

Leg member 30 is preferably tubular in construction having a threaded opening 36 extending longitudinally for the length of the tube as shown in FIG. 6. Leg member 30 also has a longitudinal slotted opening 40 (FIG. 5) through which extends pins 32 to allow pivotal movement of leg member 30 with respect to leg assembly 18 and longitudinal movement between the two components to seat the leg member within the base member as a result of cooperative movement between pins 32 and slot 40.

Figure 8:
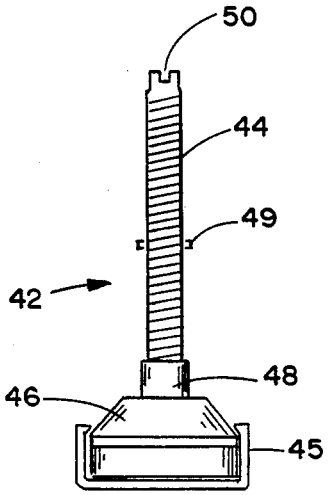
FIG. 8 is a side elevational view of the foot member in combination with a sleeve capable of moving independently of the foot member.

Foot member shown generally as 42 in FIG. 8 has an extended threaded member 44 which is cooperatively received in threaded opening 36 of leg member 30 to allow the desired positioning between leg member 30 and the supporting-surface engaging portion 46. The threaded member 44 can be adjusted by a wrench turning the fitted element 48 or by a screwdriver from inside the cabinet positioned at slot 50. While unnecessary, it is desirable to allow engaging portion 46 to spin freely with respect to element 48 and threaded member 44.

To ensure a firm, non-skidding engagement with the supporting surface by the foot member, a sleeve 45 can be frictionally secured around member 46 as shown in FIG. 8. Thus the sleeve 45 will remain stationary when threaded member 44 is rotated and no movement of the supported article with respect to the supporting surface will occur.

Figure 13:
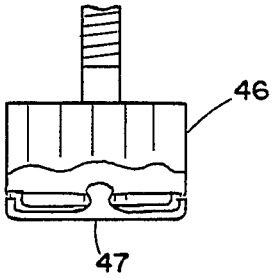
FIG. 13 is a side elevational sectional view of the foot member with another variation of a movable sleeve.

Another embodiment of a movement-controlled foot member is shown in FIG. 13. Member 46' releasably receives a free turning cap 47 that will function in the same manner as sleeve 45 described above.

Figure 14:
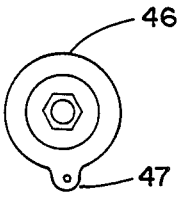
FIG. 14 is a plan sectional view of another embodiment of the boot member together with a movable sleeve having a perforated tab.
Figure 16:
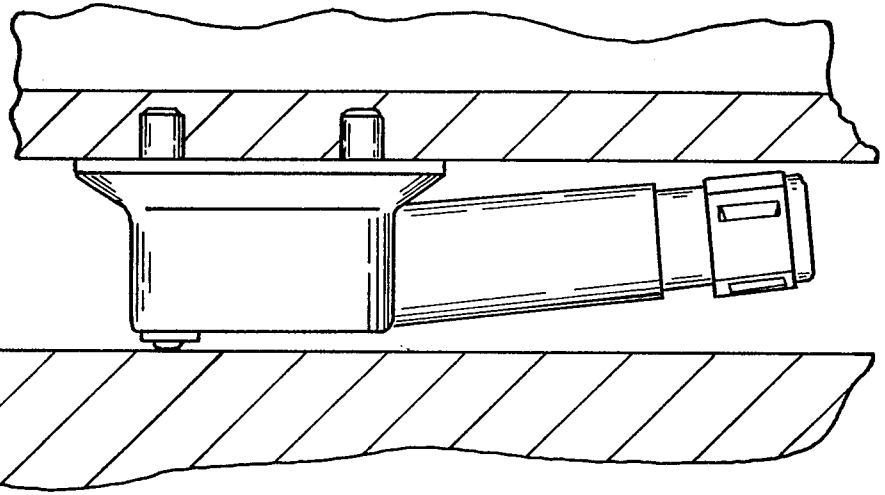
FIG. 16 is a side elevational view of the assembly shown in FIG. 16 with the leg member positioned in the folded and nested position.

Foot member 46 can be provided with a perforated tab 47' as shown in FIG. 14 so that the supported article can be fixedly secured to the supporting surface.

The present invention functions by moving leg member 30 from a nested position (substantially parallel to surface 26 of bottom 14) to a vertical position as shown in FIG. 1. Once pivotal movement has been completed, slot 40 and pins 32 enable the leg member to slide upwardly and into base member 18 to lock the leg and foot member in a fixed relationship with respect to base member 18.

It is important that the flange plate 24 of base member 18 provide an extended supporting portion for engaging the cabinet sidewall 54 as shown in FIG. 1. This furnishes additional strength in supporting all components of cabinet 12.

Figure 9:
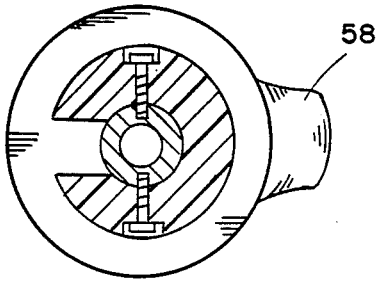
FIG. 9 is a plan view of an alternative embodiment of the base member having a supporting ledge.

The flange plate 24 of base member 18 can be configured as shown in FIG. 9 to provide a supporting ledge 58 that extends over and under the wall of an adjacent cabinet so that a leg under that contiguous cabinet will not be necessary, the base member 18 serving to carry its own directly affixed cabinet and, by the extending ledge 58, the adjacent cabinet.

The assembly comprising the present invention is readily adaptable to accommodate clips 59 associated with a toe kick panel 60 shown in FIG. 1. Such clips are often used with conventional adjustable legs and can be adapted for the present inventive concept. They may be affixed through slots, grooves or magnets. The assembly disclosed herein is adaptable for use with any surface thickness and any surface material.

It has been found advantageous to provide an adjustment tab 49 on threaded member 44 to establish a reference point on completed assemblies. Adjustments can be made much more efficiently if the units are installed by referring to such a reference point.

Figure 15:
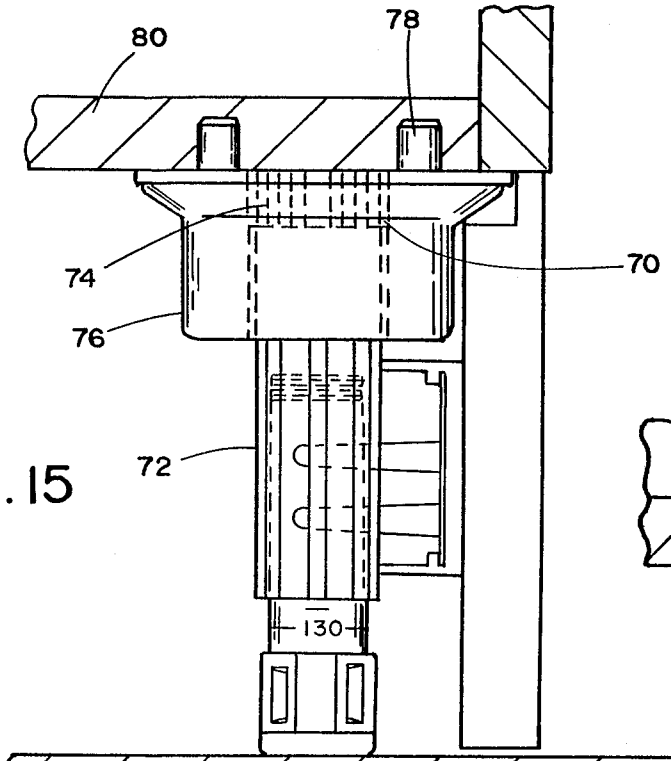
FIG. 15 is a front elevational view of another embodiment of the present invention illustrating alternative means for locking the leg member in a vertical article-supporting position with respect to the base member.
Figures 17, 18, 19, 20, 21, 22, 23, 24:
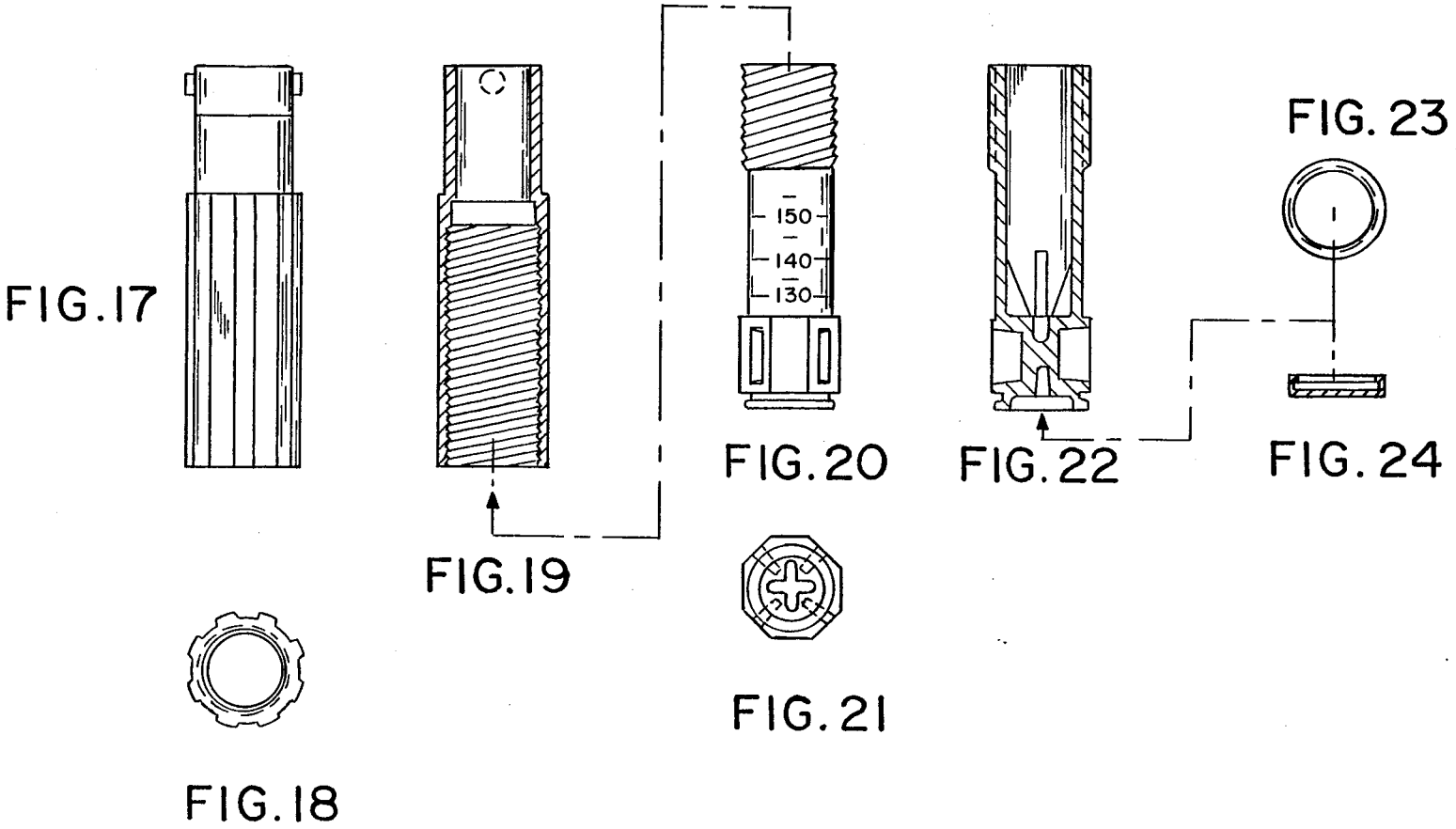
FIG. 17 is an elevational view of the leg member of the assembly shown in FIG. 15 showing the pivot means associated therewith.
FIG. 18 is a plan view of the leg member shown in FIG. 17.
FIG. 19 is an elevational and sectional view of the leg member shown in FIG. 17.
FIG. 20 is an elevational view of the foot member associated with the leg member shown in FIG. 17.
FIG. 21 is a plan view of the foot member shown in FIG. 20.
FIG. 22 is an elevational sectional view of the foot member shown in FIG. 20.
FIG. 23 is a plan view of a cap associated with the foot member shown in FIG. 20.
FIG. 24 is a side elevational, sectional view of the cap shown in FIG. 23.

Other important embodiments of the present invention include a variation in locking means shown more particularly in FIG. 15. One or more ribs 70 on leg member 72 cooperatively communicate with one or more grooves 74 in base member 76 to lock leg member 72 in a substantially vertical and article-supporting position. One or more spreadable dowels 78 extend partially through the article floor 80 as shown. Conventional fastening means such as screws, pins or the like are utilized to secure dowels 78 in their seated position.

Figures 25, 26, 27, 28, 29, 30, 31:
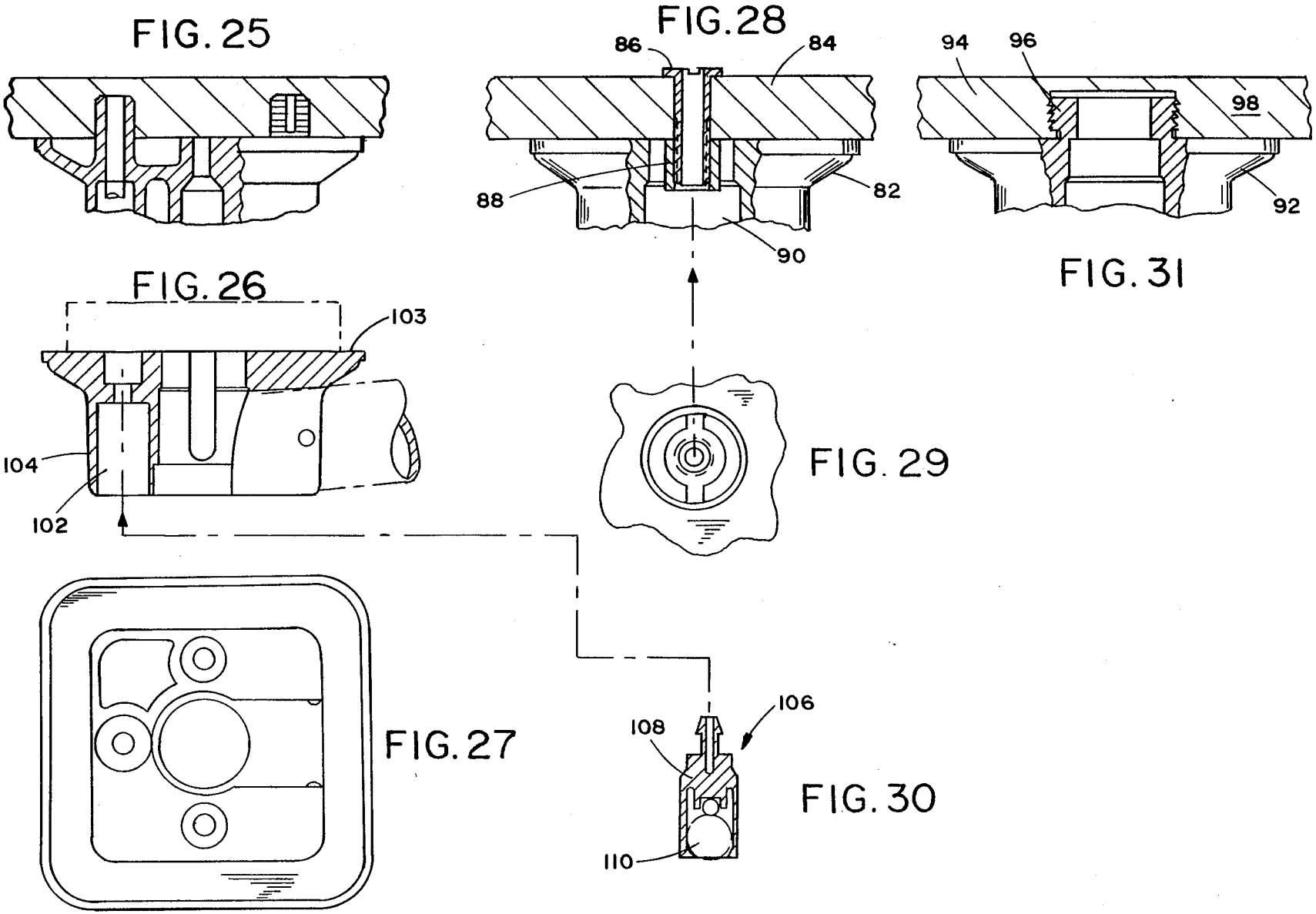
FIG. 25 is an elevational, sectional and fragmentary view of another embodiment of the assembly comprising the present invention illustrating the use of spreadable dowels formed as a part of the base member for affixing that member to the support structure.
FIG. 26 is a side elevational, sectional and fragmentary view of another embodiment of the assembly comprising the present invention illustrating a roller means socket for housing roller means to permit the article to be moved when the leg member is in the retracted position and a releasably securable device in the form of a retaining dimple.
FIG. 27 is a plan view of the device shown in FIG. 26.
FIG. 28 is an elevational, sectional and fragmentary view of another embodiment of the present invention showing alternative means for affixing the base member to the support structure.
FIG. 29 is a plan fragmentary view of the device shown in FIG. 28 taken along the lines A—A.
FIG. 30 is an elevational sectional view of a ball retainer assembly that may be used with the base member shown in FIG. 26 to transport the article over a supporting surface.
FIG. 31 is an elevational, fragmentary and sectional view of another embodiment of the assembly comprising the present invention for attaching the base member to the support structure.

Another previously discussed method of affixing base member 82 to article floor 84 is shown in FIG. 28. There, a hollow bolt 86 extends through floor 84 and engages a threaded receptacle 88 formed in the end of leg member 90.

Yet one other slightly different variation of mounting base member 92 to floor 94 is shown in FIG. 31 wherein a threaded receptacle 96 is formed in floor 98 to cooperatively receive the threaded end (not shown) of the leg member and thus avoid an irregular surface within floor 98.

It has been found advantageous to provide roller means to enable the article to be moved over a supporting surface when the leg member is in the retracted and nested position. In FIG. 26, a ball socket receptacle 102 is formed in base member 103 to retain the ball retainer assembly shown generally as 106 in FIG. 30. A casing 108 formed to be received within socket 102 will accommodate a rotatable ball bearing 110 so that the article can be moved over a supporting surface when the leg member is in a retracted or nested position.

Functional configurations of the leg member and of the bottom cap for the foot member are shown in FIGS. 17 through 24. The drawings are self-explanatory, based on the principles previously discussed, and need no additional descriptions.

Although the present invention has been described with reference to the embodiments described herein, it is understood that the disclosure has been made only by way of example and that numerous changes in construction details may be made without departing from the spirit and scope of the invention. The scope of the invention is not limited by the illustrative specification, but only by the scope of the appended claims.

What is claimed is:

1. A foldable leveller leg assembly for supporting cabinets and similar articles comprising: a base member engaging the article; a leg member pivotally connected to said base member and movable from a substantially vertical to a substantially horizontal position and back again; a foot member threadably and adjustably secured to said leg member; means securing said base member to the article; and means locking said leg member in a substantially vertical, fixed and recessed relationship with respect to said base member, said base member having an extended supporting ledge for engaging and supporting a wall of the article and further comprising movable roller means associated with said base member enabling the article to be moved over a supporting surface when said leg member is in a substantially horizontal position.

2. The assembly as claimed in claim 1 wherein said base securing means includes a threaded member extending through the article into a cooperatively compatible threaded receptacle element carried by said base member.

3. The assembly as claimed in claim 1 wherein said base securing means is a hollow bolt extending through the article's support surface.

4. The assembly as claimed in claim 1 wherein said base member securing means includes a threaded receptacle in the floor of the article support surface and a threaded end on said leg member extending through said base member and into said threaded receptacle.

5. A foldable leveller leg assembly for supporting cabinets and similar articles comprising: a base member engaging the article; a leg member pivotally connected to said base member and movable from a substantially vertical to a substantially horizontal position and back again; a foot member threadably and adjustably secured to said leg member; means securing said base member to the article; and means locking said leg member in a substantially vertical, fixed and recessed relationship with respect to said base member, said base member having a U-shaped recess allowing the pivotal movement of said leg member from a substantially horizontal position with respect to the article to a vertical position with respect thereto and back again, said locking means including one or more ribs on said leg member, one or more grooves in said base member communicating with said ribs of said leg member whereby the ribs and grooves cooperatively engage to lock said leg member in a substantially vertical position and further comprising movable roller means associated with said base member enabling the article to be moved over a supporting surface when said leg member is in said substantially horizontal position.

6. A foldable leveller leg assembly for supporting cabinets and similar articles comprising: a base member engaging the article; a leg member pivotally connected to said base member and movable from a substantially vertical to a substantially horizontal position and back again; a foot member threadably and adjustably secured to said leg member; means securing said base member to the article; and means locking said leg member in a substantially vertical, fixed and recessed relationship with respect to said base member, said base member having an extended supporting ledge for engaging and supporting a wall of the article, said locking means including one or more ribs on said leg member and one or more grooves in said base member communicating with said ribs of said leg member whereby said ribs and grooves cooperatively engage to lock said leg member in a substantially vertical position further comprising movable roller means associated with said base member enabling the article to be moved over a supporting surface when said leg member is in a substantially horizontal position.

* * * * *